United States Patent [19]

Pollina

[11] Patent Number: 4,946,632

[45] Date of Patent: Aug. 7, 1990

[54] METHOD OF CONSTRUCTING A MASONRY STRUCTURE

[76] Inventor: Peter J. Pollina, 1150 Hylan Blvd., Staten Island, N.Y. 10305

[21] Appl. No.: 229,998

[22] Filed: Aug. 9, 1988

Related U.S. Application Data

[62] Division of Ser. No. 54,514, May 27, 1987, Pat. No. 4,765,115.

[51] Int. Cl.[5] ..... B28B 1/16; B29C 33/42; B32B 31/06; E04B 1/16

[52] U.S. Cl. ..... 264/33; 264/32; 264/35; 264/256; 264/261; 264/263; 264/336

[58] Field of Search ..... 264/31–35, 264/333, 256, 259, 261, 263, 336; 52/712–714, 562, 513, 747, 384, 385, 388, 391, 426, 486

[56] References Cited

U.S. PATENT DOCUMENTS

| | | | |
|---|---|---|---|
| 2,465,871 | 3/1949 | Hardie et al. | 264/31 |
| 3,210,445 | 10/1965 | McClarney | 264/35 |
| 3,231,646 | 1/1966 | Conder et al. | 264/35 |
| 3,236,924 | 2/1966 | McClarney et al. | 264/35 |
| 3,309,828 | 3/1967 | Tribble . | |
| 3,478,479 | 11/1969 | Papalia . | |
| 3,964,226 | 6/1976 | Hala et al. . | |
| 4,689,931 | 9/1987 | Hodges . | |

*Primary Examiner*—Jan H. Silbaugh
*Assistant Examiner*—Karen D. Kutach
*Attorney, Agent, or Firm*—Shlesinger & Myers

[57] ABSTRACT

A masonry structure is made by setting up a prefabricated wire support structure having the shape of the structure to be made, assembling a first row of bricks on the lowermost horizontal section thereof, masking a plurality of brick of that row with an open top removable mortar molding form which is placed around a plurality of bricks and covering the tops of the bricks by filling the form with mortar and leveling it to provide a mortar filling layer between adjacent bricks of the run and a continuous mortar layer above the bricks.

2 Claims, 4 Drawing Sheets

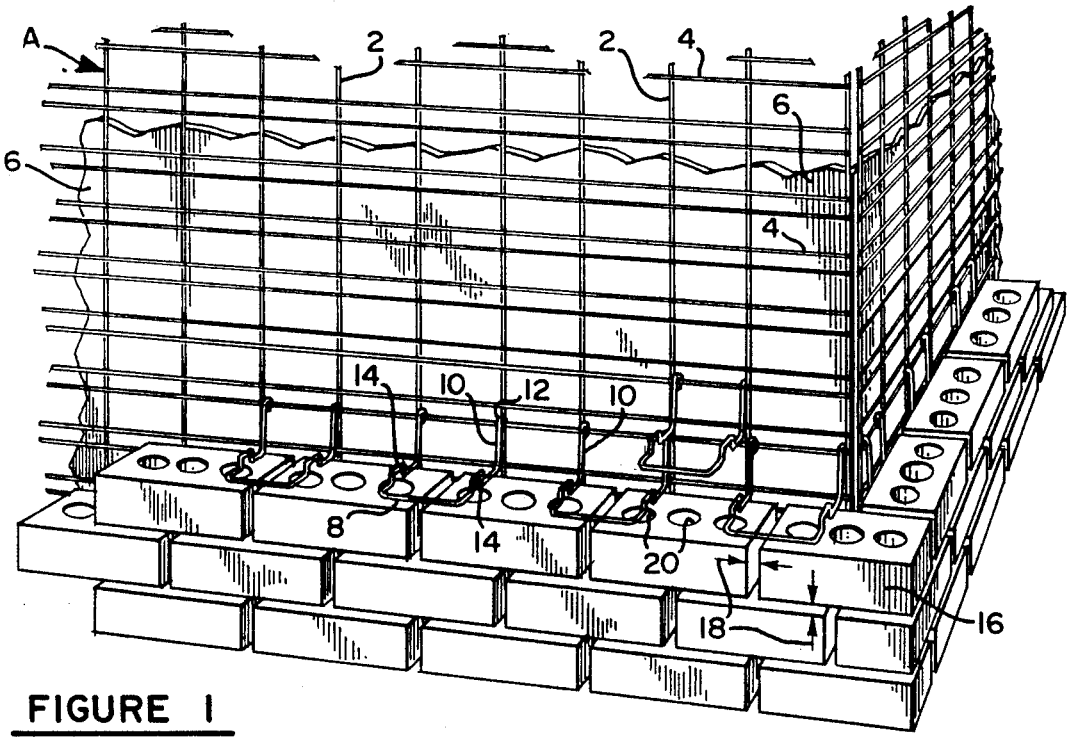
FIGURE 1
FIGURE 2
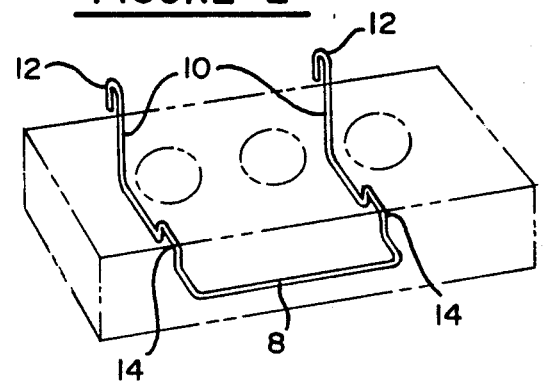
FIGURE 3
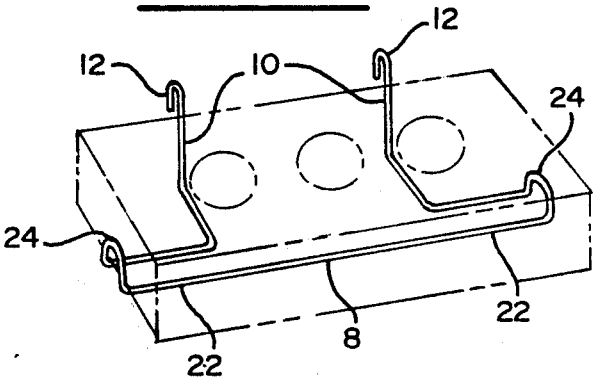
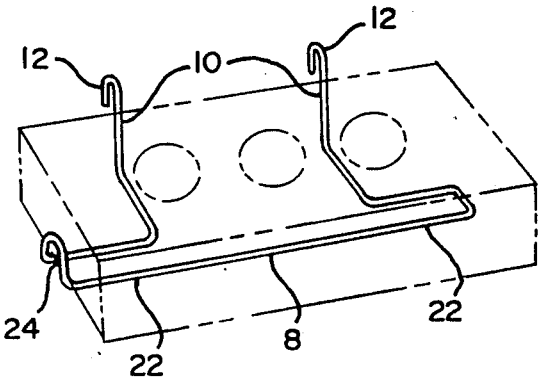
FIGURE 4
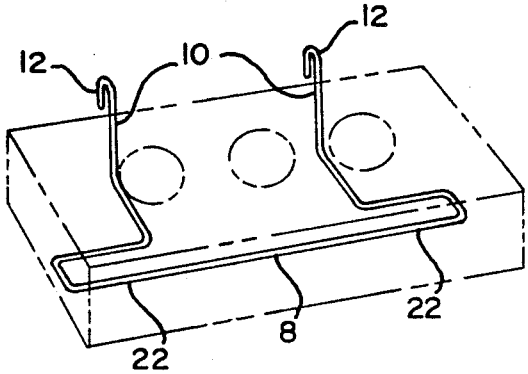
FIGURE 5

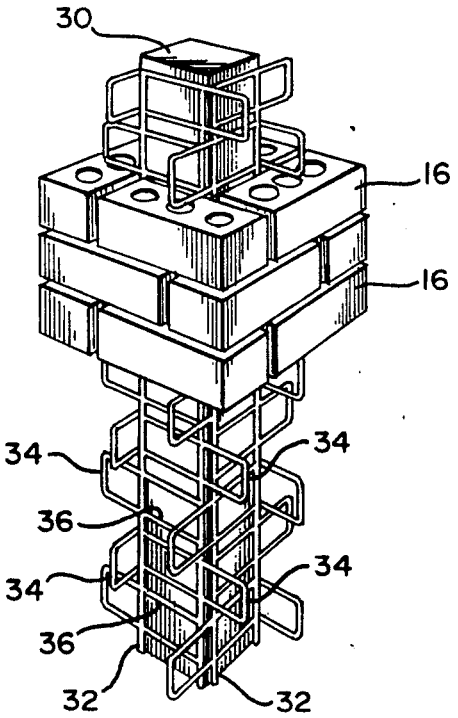
FIGURE 8
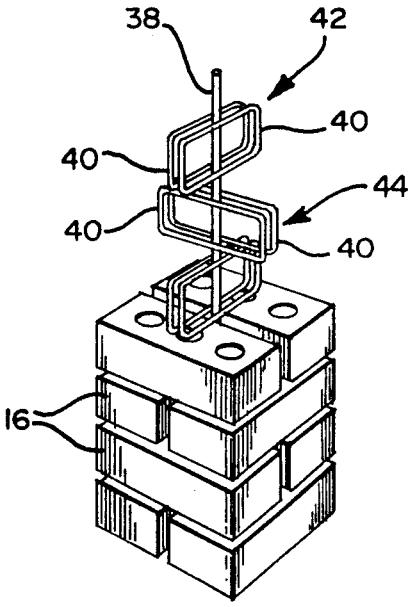
FIGURE 9
FIGURE 6
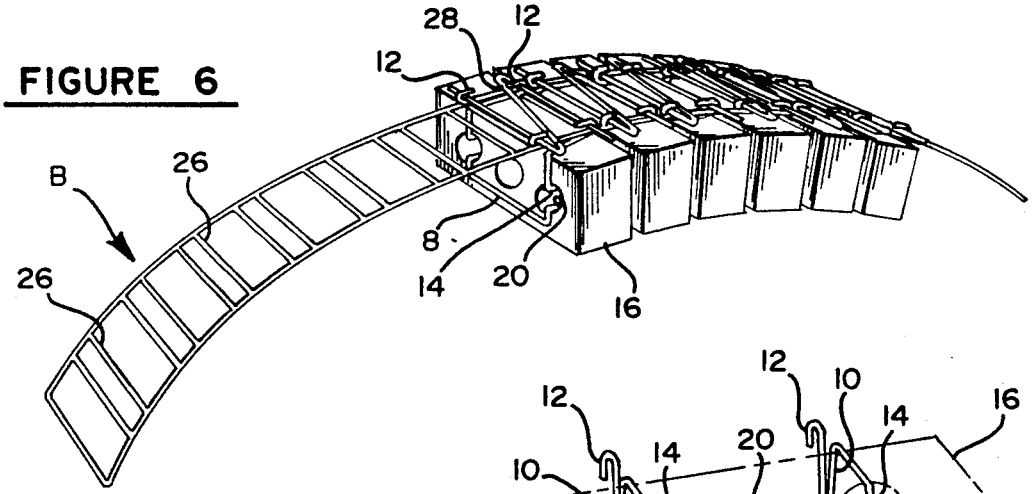
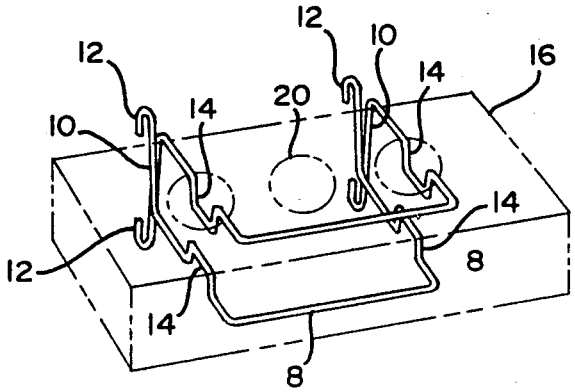
FIGURE 7

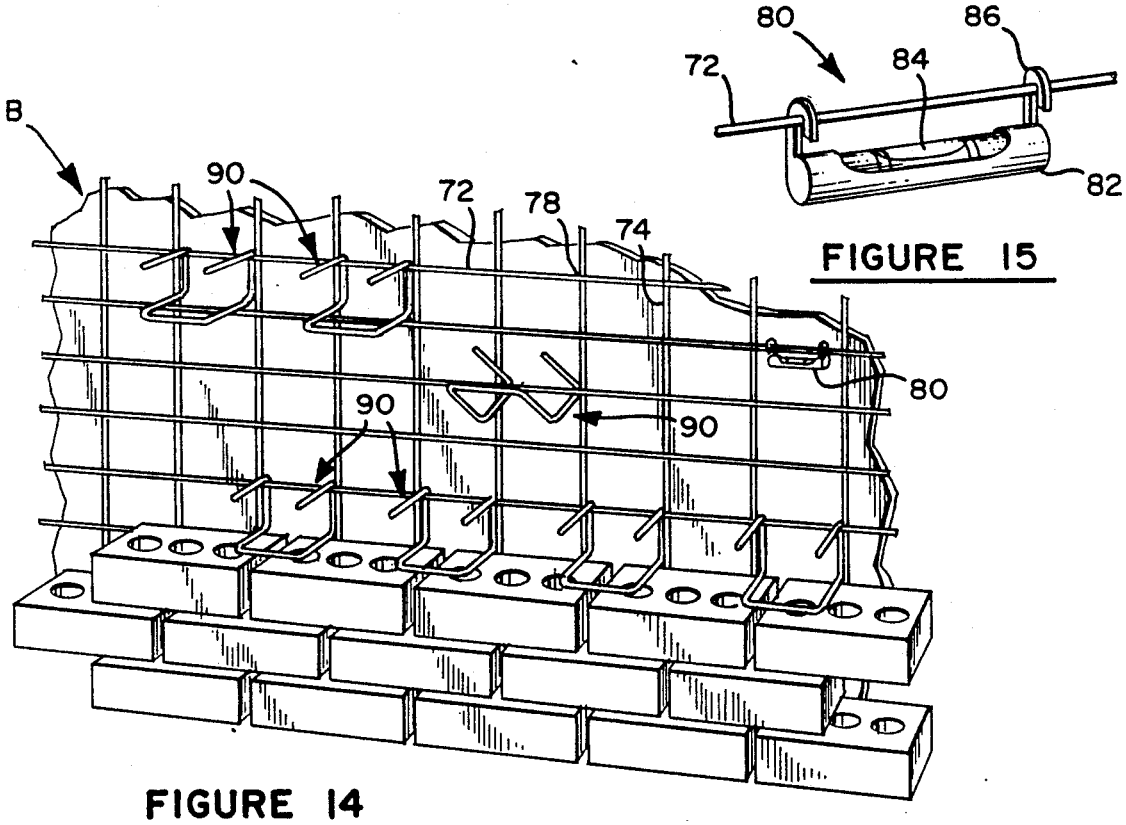
FIGURE 14
FIGURE 15
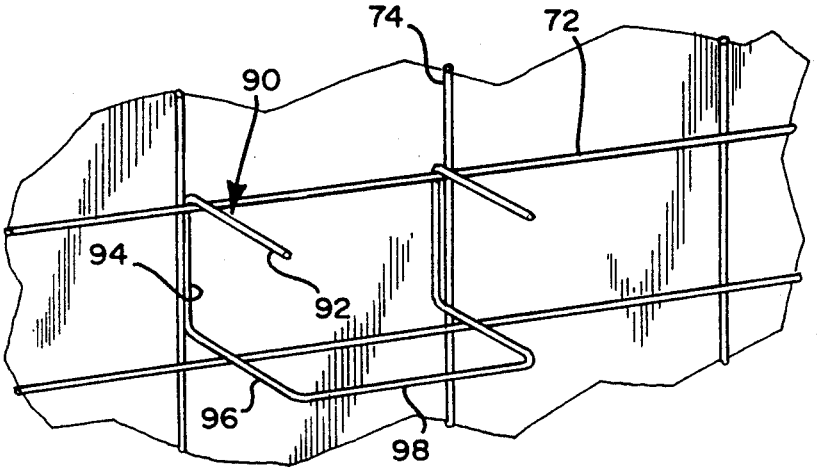
FIGURE 16
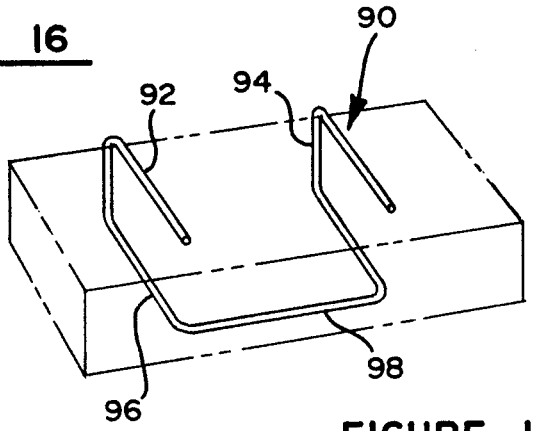
FIGURE 17

METHOD OF CONSTRUCTING A MASONRY STRUCTURE

This is a division of application Ser. No. 054,514, filed May 27, 1987, now U.S. Pat. No. 4,765,115.

FIELD OF THE INVENTION

This invention relates to pre-fabricated masonry forms for supporting brick work in pre-determined specified arrangements in order to greatly simplify the fabrication of various masonry structures.

BACKGROUND OF THE INVENTION

Various masonry forms and spacers for supporting and spacing brick work have been developed over the years. Examples of masonry forms and spacers are disclosed by Castelli, U.S. Pat. No. 3,196,581; Castelli, U.S. Pat. No. 3,420,031; Mundy, U.S. Pat. No. 3,426,497; Wargoe, U.S. Pat. No. 3,584,426; Eberhardt, U.S. Pat. No. 3,142,938; Zack, U.S. Pat. No. 1,947,239; Reintjes, U.S. Pat. No. 2,847,849; Jones, U.S. Pat. No. 3,181,278.

The references to Castelli, Mundy and Wargoe generally teach devices for providing spacing between successive vertical rows of bricks. Each of these references relies primarily upon the lowermost row of bricks for providing the required support.

Eberhardt teaches the use of a supporting planar vertical grid with horizontal support wires together with cantilevered wire support pieces which project outwardly to support pin elements extending normally from the rear faces of the facing slabs or bricks.

Reintjes discloses a series of spaced apart horizontal stringers for supporting clips which in turn engage selective specially formed bricks for positioning the same. All of the bricks are of special configuration in order to allow interlocking thereof.

Zack discloses a planar board construction in which successive wire block or brick supporting members are integrally connected with the block and subsequently driven into the backing panel.

Jones discloses a vertical panel with attached support clips. The clips engage the bricks to hold them in the desired position. This structure requires an interlocking configuration between the individual bricks.

Each of the supporting devices taught by Eberhardt, Reintjes, Zack and Jones have limited use in that each requires the use of bricks or facing slabs having specialized construction or specialized modifications. This aspect severely limits the usefulness of these devices since they cannot be used in conjunction with standard masonry brick. Since the bricks or facing slabs must be individually designed or modified, the overall cost associated with masonry structures produced using supports taught by the prior art becomes prohibitive.

SUMMARY AND OBJECTS OF THE INVENTION

The present invention provides versatile, uncomplicated and easily used brick laying supports or forms especially developed as an aid for those people lacking professional skill in the field of masonry.

One embodiment of the present invention concerns a modular unit used in constructing brick walls comprising a vertically oriented and supported planar wire support structure or grid consisting of a number of evenly spaced-apart vertical wires and a number of unevenly or staggered horizontal wires. The horizontal wires may be in pre-arranged patterns beginning with a lowermost horizontal wire intersecting the lowermost ends of the vertical wires. The second lowermost horizontal wire may be spaced from the lowermost horizontal wire by a first set distance, for example $1\frac{1}{8}$ inches. The third lowermost horizontal wire is set from the second lowermost horizontal wire by a second set distance, for example $1\frac{3}{4}$ inches. The patterns is repeated with the next lowermost wires alternatingly spaced from the previous wires by distances of $1\frac{1}{8}$ inches, $1\frac{3}{4}$ inches, etc.

The vertically oriented and supported grid is used to receive specially shaped hangers or clips which in turn support the bricks.

The hangers or clips come in a variety of sizes and shapes, however, all of the hangers have common characteristics, namely, a generally U-shaped horizontal body portion and a pair of spaced-apart legs extending vertically from opposite ends of the horizontal U-shaped body portion, the distal ends of the vertical legs being hook-shaped.

The hooked end portions of the vertical legs are used for attaching the hangers onto selected horizontal wires of the support structure or grid. Once attached, the U-shaped body portion of the hangers extending outwardly in a horizontal direction generally perpendicular to the plane of the support structure or grid.

The U-shaped body portion of the hangers is of sufficient size and construction to independently support a brick positioned thereon. The hangers are distributed upon the support structure or grid in such a manner as to allow sufficient spacing for mortar to be placed between adjacent bricks once a horizontal row of bricks has been set in place.

Other embodiments covered by the present invention include modular systems for constructing various other masonry forms including archways, columns, lamp posts, etc.

It is therefore an object of the present invention to provide modular brick structures which are uncomplicated and easy to assemble.

Another object of the present invention is to provide modular brick structures which may be fabricated from standard size and shape masonry brick.

A further object of the present invention is to provide modular brick structures which are inexpensive compared with known brick structures.

Still another object of the present invention is to provide modular brick structures of a variety of shapes including walls, columns, archways, lamp posts and fireplaces.

The foregoing and other objects and advantages of this invention will appear from the following detailed description, taken in connection with the accompanying drawings.

DESCRIPTION OF THE DRAWINGS

FIG. 1 is a fragmentary perspective view of a partially assembled wall structure according to the present invention;

FIGS. 2 through 5 are perspective views showing various embodiments of the hangers or clips used for supporting the individual bricks which are shown in phantom;

FIG. 6 is a perspective view showing partially assembled archway formed according to the present invention;

FIG. 7 is a perspective view of the hanger assembly of FIG. 6;

FIG. 8 is a fragmentary perspective view showing a partially assembled decorative column according to the present invention;

FIG. 9 is a fragmentary perspective view showing a partially assembled lamp post according to the present invention;

FIG. 14 shows a grid support structure with built in level devices.

FIG. 15 is a partial fragmentary enlarged view of a part of FIG. 14 showing the level device.

FIG. 16 shows another form of a wire hanger.

FIG. 17 shows a perspective view of the wire hanger with a brick in phantom outline.

FIG. 1

Figure 10:
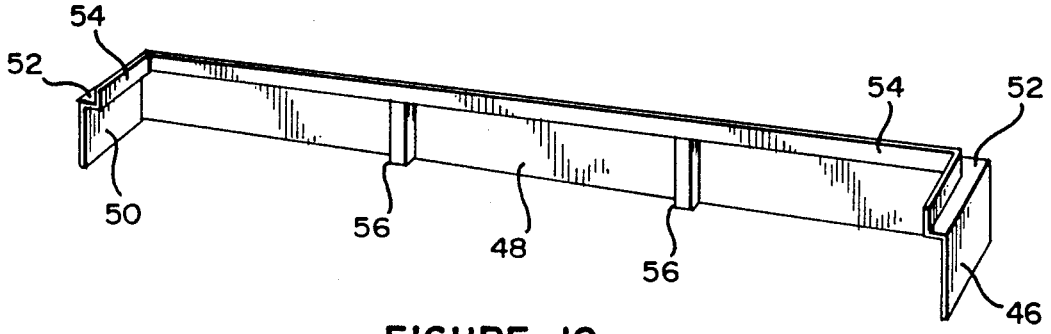
FIG. 10 is a perspective view of a mortar applicator used according to the present invention.

The modular wall assembly of FIG. 1 is comprised of a vertically oriented support structure or grid A which is formed from a plurality of equally spaced-apart vertical wires 2 and a number of unequally spaced-apart horizontal wires 4.

Support structure or grid A is preferably fastened to a backing structure such as board 6. While not shown in FIG. 1, any suitable fastening means may be used to secure grid A to backing board 6.

Horizontal wires 4 of support structure or grid A are arranged in a pre-determined pattern. The lowermost horizontal wire intersects and is connected to the lowermost ends of vertical wires 2. The second lowermost horizontal wire is spaced a first set distance, for example $1\frac{1}{8}$ inches from the lowermost horizontal wire. The third lowermost horizontal wire is positioned at a second set distance, for example $1\frac{3}{4}$ inches from the second lowermost horizontal wire. The pattern is repeated with each successive horizontal wire being alternatingly spaced from the preceding wire by distances of $1\frac{1}{8}$ inches, $1\frac{3}{4}$ inches, etc. The vertically oriented wires 2 are preferably spaced apart at $4\frac{1}{4}$ inch intervals.

Wire hangers or clips 8 are attached to grid A in a pre-determined pattern as shown in FIG. 1. Each hanger 8 is of one piece construction and includes a generally U-shaped horizontal body portion and a pair of legs 10 extending vertically from opposite ends of the generally horizontal U-shaped portion. The distal end of each vertical leg 10 comprises a hooked portion 12. Hooked portion 12 is adapted for engagement of selected horizontal wires 4 of grid A. The proximal end portions of vertical legs 10 are situated in a manner so that they rest against the horizontal wire directly beneath the hook engaged horizontal wire in order to provide additional support and to ensure that the horizontal main body portion extends perpendicular to grid A. Hangers 8 may include vertical projections 14 for the purpose to be explained later.

When hangers 8 are positioned on grid A in the manner shown in FIG. 1, with each hanger supporting an individual brick 16, a pre-determined spacing 18 is formed between adjacent bricks, spacing 18 being filled with mortar.

When bricks 16 are provided with openings 20, projections 14 will engage openings 20 from the bottom face of the brick thereby providing additional stability.

FIGS. 2 THROUGH 5

Referring to FIGS. 2 through 5, it may be seen that hangers or clips 8 may assume a variety of shapes, each of which provides suitable support for the individual bricks 16 resting thereon.

Each of the hangers shown in FIGS. 3, 4 and 5 vary from the hanger of FIGS. 1 and 2 by the inclusion of laterally extending wings 22. The distal portion of each wing 22 may terminate in the form of a vertical projection 24 as depicted in FIGS. 3 and 4. Vertical projections 24 will engage the side faces of bricks 16.

FIGS. 6 AND 7

FIGS. 6 and 7 show a modular suspension unit in the shape of an archway. The modular unit includes a pre-shaped wire support structure B. Wire support structure B is reinforced by means of cross ties 26. The cross ties 26 may be arranged in a pre-determined pattern to provide a gauge for spacing the individual bricks 16 allowing room for mortar to be placed between adjacent bricks 16.

Two hangers 8 having identical structure as the hangers shown in FIGS. 1 and 2 are used to support each brick 16.

As shown in FIG. 7, the hangers 8 engage brick 16 from either side with hanger projections 14 likewise engaging openings 20 from either side of the brick. This arrangement results in two pairs of opposed hook ends 12 being directed at each other adjacent one face of the brick.

The brick with the assembled hangers 8 are positioned adjacent the base of support structure B with hook ends 12 extending above support structure B. The brick is locked in place by applying an S-shaped spring clamp 28 on top of support structure B and in engagement with hook ends 12.

Using cross ties 26 of support structure B as gauging elements, the remaining bricks are assembled onto support structure B with the required spacing between adjacent bricks for receiving mortar.

FIG. 8

FIG. 8 shows a modular form used in fabricating a brick column. The form includes a rectangular shaped wood core 30. Identical shaped wire support structures or grids 32 are fastened to each side face of wood core 30. Each wire support structure 32 includes lateral extensions 34 alternatingly extending from either side thereof. Each support structure 32 has a ladder-like configuration including rungs 36. Rungs 36 are spaced apart in the same manner as horizontal wires 4 of grid A as shown in FIG. 1. Support structures 32 may be attached to wood core 30 by any suitable fastening means.

The wire support structures or grids 32 act as gauges for placement of the individual bricks during assembly of the column structure. The lateral extensions 34 provide end stops for end faces of the brick, thereby ensuring regularity and flushness of the completed column faces. In addition, extensions 34 serve as spacers between adjacent bricks providing the proper amount of clearance for subsequent reception of mortar.

FIG. 9

FIG. 9 depicts the modular assembly and form used in fabricating a mail box or lamp post.

The assembly includes a vertically oriented central rod or bar 38. Pairs of rectangular shaped wire frames 40 are attached by welding or other suitable means to opposite sides of rod 38 in order to form a first spacing unit 42. An additional pair of rectangular wire frames 40 are fastened to opposite sides of rod 38 to form a second spacing unit 44. Spacing unit 44 is located at a set distance vertically beneath spacing unit 42 and oriented at a right angle thereto.

The pattern of the spacing units continues as shown in FIG. 9.

The spacing units serve as a guide for placement of the brick layers providing proper clearance between adjacent bricks in each layer for the subsequent reception for mortar.

FIGS. 10 THROUGH 13

FIG. 10 shows a mortar applicator C which is used when assembling a wall unit as depicted in FIG. 1. Mortar applicator C includes vertical side walls 46, 48 and 50, an inwardly directed horizontal flange 52 and a vertical flange 54.

A plurality of spaced apart spacing elements 56 extend inwardly from wall 48. Spacing elements 56 project a short distance into the spaces formed between adjacent bricks in order to cause the mortar to be recessed or tooled during application of the mortar into the spaces between adjacent bricks. The distance between adjacent spacing elements 56 corresponds to the overall length of the individual bricks. The height of vertical walls 46, 48 and 50 correspond to the overall height of the individual bricks. The width of side walls 46 and 50 generally corresponds to the width of the individual bricks.

When Mortar applicator C is placed around a corresponding number of bricks, the bricks are nested between vertical walls 46, 48 and 50, with spacing elements 56 projecting slightly into the spaces between adjacent bricks. Horizontal flange 52 covers a marginal portion of the bricks. Horizontal flange 52 in conjunction with spacing elements 56 cause the bricks to be automatically tooled during application of the mortar.

Figure 11:
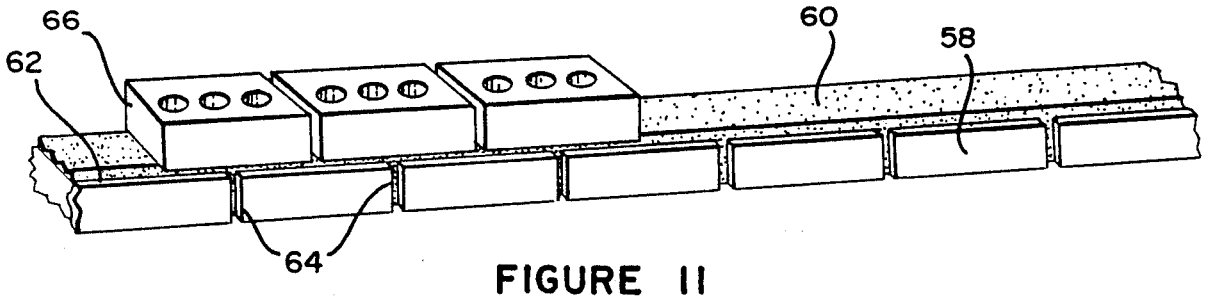
FIGS. 11 through 13 are perspective view showing the various stages of assembly of a new row of bricks during formation of a wall structure according to FIG. 1.
Figure 12:
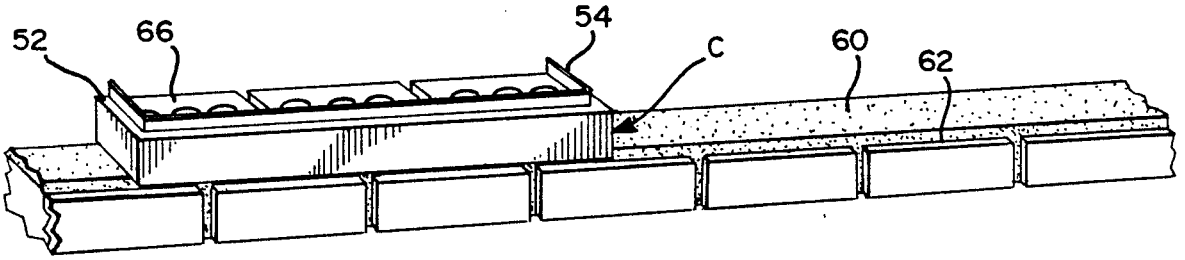
Figure 13:
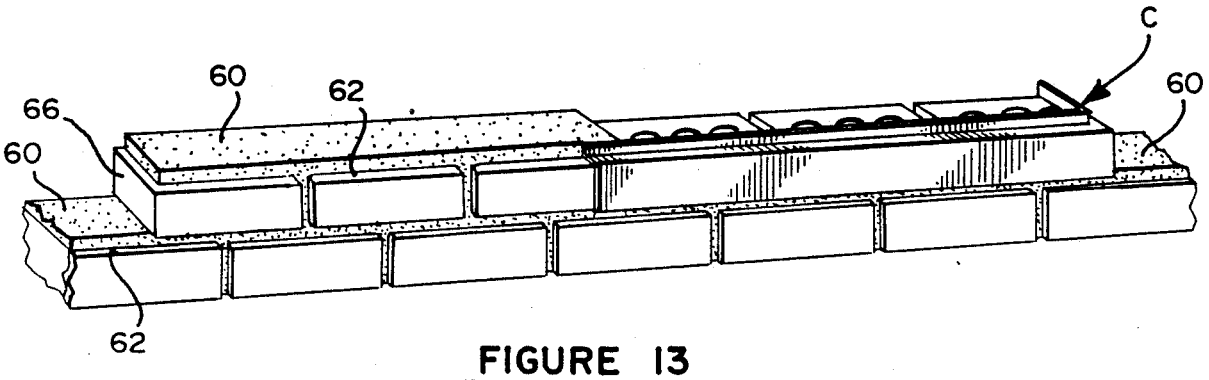

FIGS. 11 through 13 show the sequence of brick laying and mortar application during preparation of a wall structure such as the wall structure of FIG. 1. For illustrative purposes, the backing structure 6, grid A and hangers 8 have been omitted from FIGS. 11 through 13.

As shown in FIG. 11, a completed horizontal row 58 of bricks has already been layed, and mortar 60 has been applied to the surface of row 58 as well as within the spaces left between adjacent bricks. Mortar 60 is recessed leaving an uncovered marginal region 62 along the upper peripheral surface of the bricks. In addition, the mortar is recessed within spaces 64 between adjacent bricks.

After a completed horizontal row 58 of bricks has been layed and mortar applied, a new row of bricks 66 may be started. Before placement of a new row 66 of bricks, a row of hangers (not shown) are assembled onto the vertical grid (not shown) with the horizontal portion of the hangers resting upon the upper surface of the mortar 60.

After the hangers have been positioned as described above, a partial new row of bricks 66 are assembled onto the hangers to rest thereon.

As shown in FIG. 12, mortar applicator C is then positioned around the partial row of bricks 66 with horizontal flange 52 covering a marginal portion along the upper periphery of the bricks. In addition, spacing elements 56 (FIG. 10) project a slight distance into the spaces between the individual bricks.

Mortar is then applied on top of the partial new row 66 of bricks to a height equivalent to the height of vertical flange 54 of applicator C. In addition to covering the upper surfaces of the new row of bricks, the mortar will be caused to flow into the unrestricted spaces between the individual bricks. The mortar may be smoothed out by traversing the upper surface of vertical flange 54 with a suitable wiping element. Applicator C is removed once the mortar has partially set to a point where it will retain its shape.

The process of applying additional hangers and bricks is repeated and the mortar applicator applied around a new partial row of bricks as shown in FIG. 13. The sequence of steps is repeated until a new row of bricks has been completely assembled.

As shown in FIG. 13, the mortar applicator C is identical with the mortar applicator shown in FIGS. 10 and 12 with the exception that one side has been omitted. The two sided applicator of FIG. 13 is used to complete the row of bricks once the initial bricks have been laid.

The masonry structures shown in FIGS. 8 and 9 are assembled in a manner similar to the manner of fabricating the masonry wall shown in FIGS. 11 through 13. In each case, the structures are built up row by row until the entire structure has been completed.

Mortar applicators having the same features as the applicators previously described are used during construction of the structures of FIGS. 8 and 9. It is apparent that the applicators would be modified slightly in order to conform to the shape of the structures being fabricated.

It should be further noted that for purposes of illustration, the mortar has been omitted from FIGS. 1, 8 and 9.

FIGS. 14 THROUGH 17

FIG. 14 discloses the manner in which the grid structure is maintained at a horizontal elevation to insure that bricks are placed in a level course.

The grid structure is generally indicated at B as horizontal wire elements 72 and vertical elements 74 which are connected at their cross points 78 by welding or other means. A plurality of levels generally indicated at 80 are fastened at an end of the horizontal wires 72.

As illustrated in FIG. 15, the level element 80 has a fluid containing capsule 82 and a level bubble 84. The capsule is fastened by means of hooks 86 to the horizontal wire 72.

FIG. 16 shows a simplified hanger element generally indicated at 90 which has top outwardly extending wire engaging arms 92, downwardly extending legs 94, and a central brick supporting U-shaped wire brick support element having outwardly extending horizontal legs 96 which are joined by a central horizontal wire element 98.

The manner in which the hanger 90 supports a brick which fits between the elements 92 and 96, is shown in FIG. 17.

The manner in which the hanger 90 is fastened to the grid is illustrated in central portion of FIG. 14. It will be noted that the hanger is tilted so that the outwardly extending legs 92 can be fitted behind and then rotated into position over one of the horizontal wires 72.

The method of constructing a modular tooled masonry structure according to the present invention includes the steps of providing a pre-fabricated wire support structure having a shape generally corresponding to the shape of the completed masonry structure; assembling a first row of bricks in a pre-determined pattern onto the support structure using the support structure as a support and spacing guide for the bricks; masking selected areas of the bricks by partially surrounding the bricks with an open top removable mortar molding form; applying a pre-determined amount of mortar into the mortar molding form covering accessible unmasked areas of the bricks with a pre-determined thickness of mortar; allowing the mortar to partially set; removing the mortar molding form from the bricks thereby revealing a tooled row of bricks; and repeating the preceding steps as needed to complete the structure.

In addition to determining the quantity of mortar used, the mortar molding form also serves to protect the face of the bricks to prevent mortar staining.

While this invention has been described as having preferred design, it is understood that it is capable of further modification, uses and/or adaptations of the invention following in general the principal of the invention and including such departures from the present disclosure as come within known or customary practice in the art to which the invention pertains, and as may be applied to the essential features set forth, and fall within the scope of the invention of the limits of the appended claims.

What is claimed is:

1. In a method of constructing modular tooled masonry structures comprising the steps of:

(a) providing a pre-fabricated wire support structure having a shape generally corresponding to the shape of the completed masonry structure, (b) assembling a first lowermost horizontal row of bricks in a pre-determined pattern onto said support structure using said support structure as a support and spacing guide for said bricks, (c) placing an open top removable mortar molding form having an elongated forward vertical wall with equally spaced internal projecting vertical spacing elements adapted to interfit between adjacent bricks, and a continuous inverted inwardly directed horizontal flange assembly having an upper vertical flange the width of the desired mortar layer to be formed above said bricks, said inwardly directed horizontal flange assembly adjacent the upper edge of said elongated forward vertical wall for engaging and resting on the upper surface edge of said bricks adjacent their external face, which molding form is placed upon and partially surrounds a plurality of said bricks of said horizontal row, (d) applying a pre-determined quantity of mortar into said mortar molding form thereby covering accessible unmasked areas of said bricks with a pre-determined thickness of mortar and forming tooled masonry joints between said bricks, (e) covering the upper surface of said bricks with mortar by filling said open top of said form to the top edge of said vertical flange and leveling said mortar to provide a uniform thickness mortar layer with an upper surface flush with said top edge of said form, (f) allowing said mortar to partially set, (g) removing said mortar molding form from said bricks, successively repeating the application of said molding form and said mortar horizontally along adjacent sections of said horizontal row of bricks to complete the applying of said mortar to said horizontal brick row thereby forming a portion of said modular tooled masonry structures.

2. In the method of constructing modular tooled masonry structures as set forth in claim 1, further including the steps of:

(a) applying a plurality of hanger elements to said wire support structure in a horizontal line to support a single row of bricks, and (b) resting a horizontal row of spaced bricks on the hanger members.

* * * * *